US009966182B2

(12) United States Patent
Stamper et al.

(10) Patent No.: US 9,966,182 B2
(45) Date of Patent: May 8, 2018

(54) MULTI-FREQUENCY INDUCTORS WITH LOW-K DIELECTRIC AREA

(71) Applicant: GLOBALFOUNDRIES INC., Grand Cayman (KY)

(72) Inventors: Anthony K. Stamper, Burlington, VT (US); Venkata Narayana Rao Vanukuru, Bangalore (IN)

(73) Assignee: GLOBALFOUNDRIES INC., Grand Cayman (KY)

( * ) Notice: Subject to any disclaimer, the term of this patent is extended or adjusted under 35 U.S.C. 154(b) by 75 days.

(21) Appl. No.: 14/942,311

(22) Filed: Nov. 16, 2015

(65) Prior Publication Data

US 2017/0140865 A1 May 18, 2017

(51) Int. Cl.
*H01F 27/28* (2006.01)
*H01F 41/04* (2006.01)

(52) U.S. Cl.
CPC ..... *H01F 27/2804* (2013.01); *H01F 41/041* (2013.01); *H01F 2027/2809* (2013.01)

(58) Field of Classification Search
CPC ..... H01F 2027/2809; H01F 27/2804; H01F 21/00; H01F 2021/125
See application file for complete search history.

(56) References Cited

U.S. PATENT DOCUMENTS 5,539,241 A * 7/1996 Abidi ..... H01L 23/645 257/533
6,495,903 B2 12/2002 Xu et al.
6,534,843 B2 3/2003 Acosta et al.
6,762,088 B2 7/2004 Acosta et al.
6,835,631 B1 12/2004 Zhen et al.
7,566,627 B2 7/2009 Matz et al.
7,662,722 B2 2/2010 Stamper et al.
7,733,206 B2 * 6/2010 Park ..... H01F 17/0006 336/200
7,786,586 B2 8/2010 Kwak
7,939,909 B2 5/2011 Lee et al.
2004/0017278 A1 1/2004 Castaneda et al.
2005/0052272 A1 * 3/2005 Tiebout ..... H01F 17/0006 336/232

(Continued)

OTHER PUBLICATIONS

Dehan et al., "Tapped Integrated inductors: Modelling and Application in Multi-Band RF Circuits", IEEE European Microwave Integrated Circuit Conference (EuMIC), Oct. 2008, pp. 234-237.*

(Continued)

*Primary Examiner* — Elvin G Enad
*Assistant Examiner* — Malcolm Barnes
(74) *Attorney, Agent, or Firm* — David Cain; Andrew M. Calderon; Roberts Mlotskowski Safran Cole & Calderon, P.C.

(57) ABSTRACT

This disclosure relates generally to semiconductors, and more particularly, to structures and methods for implementing high performance multi-frequency inductors with air-gaps or other low-k dielectric material. The structure includes: a plurality of concentric conductive bands; a low-k dielectric area selectively placed between inner windings of the plurality of concentric conductive bands; and insulator material with a higher-k dielectric material than the low-k dielectric area selectively placed between remaining windings of the plurality of concentric conductive bands.

19 Claims, 3 Drawing Sheets

(56) References Cited

U.S. PATENT DOCUMENTS

| | | | | |
|---|---|---|---|---|
| 2005/0093668 | A1* | 5/2005 | Bueyuektas | H01L 23/5227 336/200 |
| 2007/0158782 | A1* | 7/2007 | Heikkinen | H01F 17/0006 257/531 |
| 2010/0022063 | A1 | 1/2010 | Erturk et al. | |
| 2012/0212316 | A1* | 8/2012 | Cho | H01L 23/5225 336/200 |
| 2013/0175073 | A1* | 7/2013 | Cooney, III | H01L 23/5227 174/257 |
| 2013/0265132 | A1* | 10/2013 | Huang | H01F 27/2804 336/200 |
| 2015/0130291 | A1* | 5/2015 | Lim | H01F 27/2804 336/200 |
| 2015/0130579 | A1* | 5/2015 | Kim | H01F 27/2804 336/200 |

OTHER PUBLICATIONS

López-Villegas et al., "Improvement of the Quality Factor of RF Integrated Inductors by Layout Optimization", IEEE, 2000, 8 pages.*

Krishnapura et al., "Compact lowpass ladder filters using tapped coils", IEEE, 2009, 4 pages.

Dehan et al., "Tapped integrated inductors: Modelling and Application in Multi-Band RF Circuits", Microwave Integrated Circuit Conference, 2008, Abstract.

Ito et al., "Characterization of On-Chip Multiport Inductors for Small-Area RF Circuits", IEEE Translations on Circuits and Systems I: Regular Papers, 2008, vol. 56, Issue 8, Abstract.

Zolfaghari et al., "Stacked inductors and transformers in CMOS technology", Journal of Solid-State Circuits, IEEE, 2001, Abstract.

* cited by examiner

MULTI-FREQUENCY INDUCTORS WITH LOW-K DIELECTRIC AREA

FIELD OF THE DISCLOSURE

The present disclosure relates generally to semiconductors, and more particularly, to structures and methods for implementing high performance multi-frequency inductors with a selected low-k dielectric area.

BACKGROUND

An inductor is an important component for an electric circuit with a resistor, a capacitor, a transistor and a power source. The inductor has a coil structure where a conductor is wound many times as a screw or spiral form, as an example. The inductor suppresses a rapid change of a current by inducing voltage in proportion to an amount of a current change. A ratio of counter electromotive force generated due to electromagnetic induction according to the change of the current flowing in a circuit is called an inductance (L).

Generally, the inductor is used for an Integrated Circuit (IC) for communication systems including high performance RF filters, and distributed amplifiers. In particular, inductors are used in a packaging technology for integrating many elements to a single chip, known as a System on Chip (SoC). Accordingly, an inductor having a micro-structure and good electrical characteristics is needed.

SUMMARY

In an aspect of the disclosure, a structure includes: a plurality of concentric conductive bands; a low-k dielectric area selectively placed between inner windings of the plurality of concentric conductive bands; and insulator material with a higher-k dielectric material than the low-k dielectric area selectively placed between remaining windings of the plurality of concentric conductive bands.

In an aspect of the disclosure, a multi-port inductor structure includes: a plurality of conductive bands; an airgap or low-k dielectric material placed between two innermost windings of the plurality of conductive bands; and an insulator material with a dielectric constant greater than the airgap or low-k dielectric material is selectively placed between remaining windings of the plurality of conductive bands.

In an aspect of the disclosure, a method includes: forming a plurality of conductive bands; forming low-k dielectric area between two innermost windings of the plurality of conductive bands; and forming an insulator material with a dielectric constant greater than the low-k dielectric area between remaining windings of the plurality of conductive bands.

BRIEF DESCRIPTION OF THE DRAWINGS

The present disclosure is described in the detailed description which follows, in reference to the noted plurality of drawings by way of non-limiting examples of exemplary embodiments of the present disclosure.

DETAILED DESCRIPTION

Figure 1:
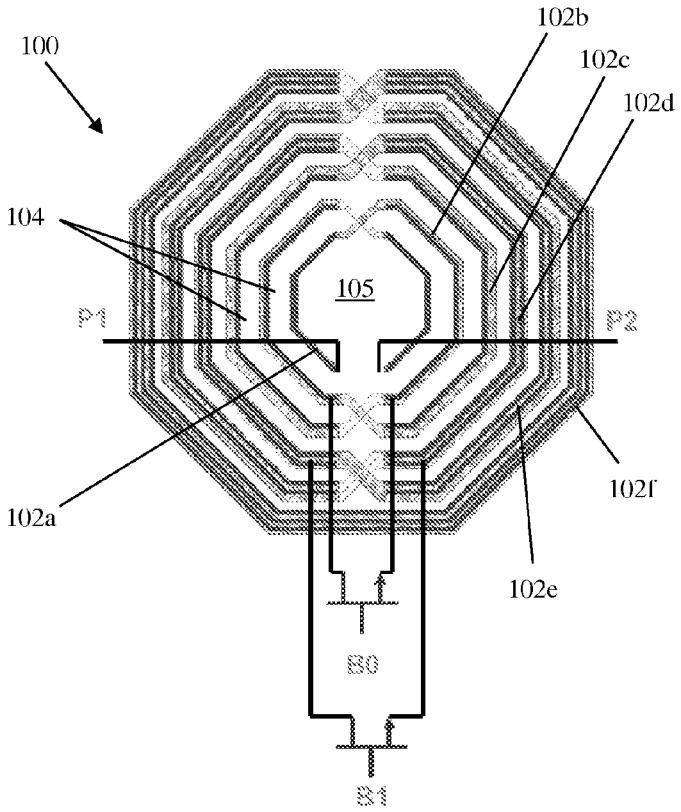
FIG. 1 is a top-down view showing an inductor in accordance with aspects of the disclosure.

The present disclosure relates generally to semiconductors, and more particularly, to structures and methods for implementing high performance multi-frequency inductors with a low-k dielectric area, e.g., airgaps or low-k or ultra low-k dielectric material. More specifically, the present disclosure is directed to multi-port, multi-frequency inductors for differential multi-band RF circuits including, e.g., high performance RF filters and distributed amplifiers. Advantageously, the multi-port, multi-frequency inductors described herein have significantly reduced area or space, compared to conventional inductors, and have reduced self-heating. Moreover, the inductors described herein have improved performance over a wide range of frequency bands.

More specifically, the inductors described herein are high performance multi-port inductor structures compatible with CMOS processes. In embodiments, the inductor structures include a low-k dielectric area such as airgaps or low-k or ultra low-k dielectric material (e.g., hafnium based materials (e.g., $HfO_2$) in the inner windings, which reduces self-heating by a factor of approximately 100× (compared to placing airgaps or low-k or ultra low-k dielectric material over the entire inductor). In embodiments, the inductor can include variable or constant winding spacing and wiring widths optimized for low-k dielectric material. Additional advantages of the inductors described herein, e.g.:

(i) improves fracture strength and mechanical properties;

(ii) occupies much lesser area than conventional inductors;

(iii) exhibits higher Qs across different frequency bands;

(iv) exhibits high inductance density across the different frequency bands;

(v) provides flexibility to maximize performance at any desired frequency band; and (vi) provides excellent electric characteristics especially with (high resistivity) HR technologies.

In embodiments, the inductor can be a 3-D multi-frequency, multi-port inductor structure composed of multiple (e.g., three or more) spiral sections of wiring structures (conductors) each of which can include the feature of varying width and spacing, where the width reduces gradually going from outer to the inner turns and the spacing does the opposite. In alternative embodiments, the segments of wiring structures (conductors) can also have constant width and spacing therebetween. In any scenario, the inductors described herein include airgaps or low-k or ultra low-k dielectric material on the inner windings, only, to reduce self-heating and provide improved performance characteristics.

The inductors of the present disclosure can be manufactured in a number of ways using a number of different tools. In general, though, the methodologies and tools are used to form structures with dimensions in the micrometer and nanometer scale. The methodologies, i.e., technologies, employed to manufacture the symmetric multi-port inductors have been adopted from integrated circuit (IC) technology. For example, the structures of the present disclosure are built on wafers and are realized in films of material patterned by photolithographic processes on the top of a wafer. In particular, the fabrication of the symmetric multi-port inductors uses three basic building blocks: (i) deposition of thin films of material on a substrate, (ii) applying a patterned mask on top of the films by photolithographic imaging, and (iii) etching the films selectively to the mask.

FIG. 1 is a top-down view showing an inductor in accordance with aspects of the disclosure. The structure 100 includes a plurality of concentric bands 102*a*, 102*b*, 102*c*, 102*d*, 102*e*, 102*f*, with a low-k dielectric area 104, e.g., airgap or low-k or ultra low-k dielectric material, formed within the inner concentric bands, e.g., 102*a*, 102*b* and 102*b*, 102*c*. To compensate for the self-heating issue, the airgap or low-k (or ultra low-k) dielectric material (relative to silicon dioxide) can be provided in the high frequency portion of the inductor, e.g., the center of the inductor. For example, the low-k dielectric area 104 can be about, e.g., 25 μm×25 μm (compared to an entire area of the inductor, e.g., 250 μm×250 μm), thus reducing self-heating by approximately 100× compared to placing an airgap over the entire inductor. Also, the use of other insulator material (which has a dielectric constant greater than air or the low-k dielectric material, e.g., silicon dioxide) around the remaining portions of the inductor will improve fracture strength and mechanical properties of the inductor.

Figure 3:
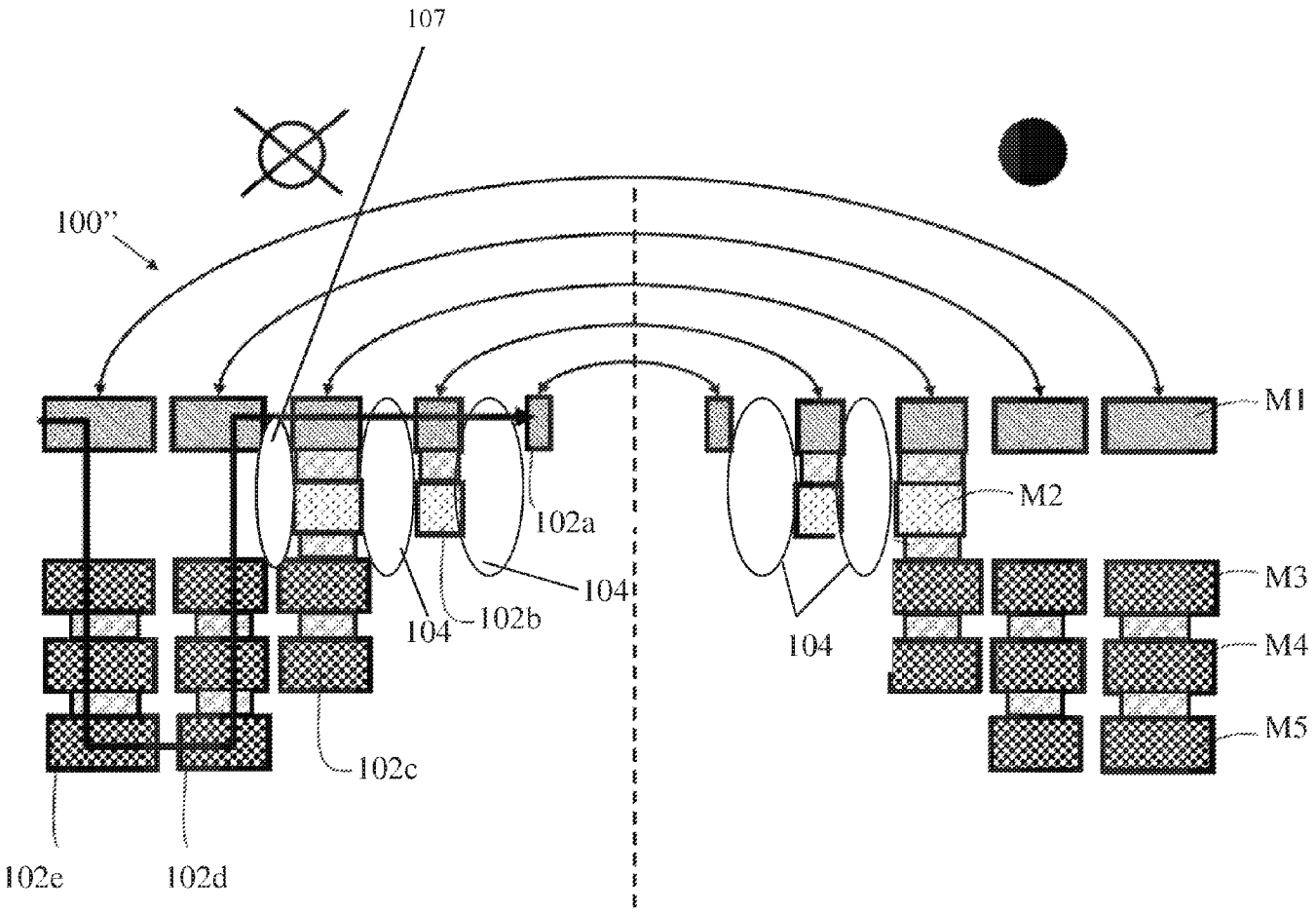
FIG. 3 is a cross-section view of an inductor structure in accordance with aspects of the present disclosure.

As should be understood by those of ordinary skill in the art and as described with respect to FIG. 3, for example, the inductor 100 can include several different wiring layers and winding configurations, e.g., concentric band 102*a* can include a single wiring layer; whereas, concentric bands 102*b*, 102*c*, 102*d*, 102*e*, 102*f* can include two or more wiring layers. The inner metal band 102*a* further comprises ports P1, P2 which may be used as a contact point for the inductor structure. Also, although the inductor 100 is described with regard to a hexagonal, spiral structure, one of skill in the art would understand that the metal wiring structures, e.g., 102*a*, 102*b*, 102*c*, 102*d*, 102*e*, 102*f*, may be formed in any number of different shapes, including octagonal, square, rectangle, circular, etc., with a certain number of turns, e.g., three, five, six, seven, etc. The concentric bands 102*a*, 102*b*, 102*c*, 102*d*, 102*e* and 102*f* of the inductor structure 100 can be made of any metal material, for example, copper, tungsten, aluminum, or other suitable conductors or combinations thereof using conventional CMOS fabrication processes as noted herein.

In embodiments, the concentric bands 102*a*, 102*b*, 102*c*, 102*d*, 102*e* and 102*f* can be made in a symmetrical pattern (although other patterns are also contemplated herein), and can be formed with a width that decreases inwardly within the structure, as the bands reach the center 105 of the structure 100. Specifically, (i) a width of the concentric band 102*a* is less than the width of concentric band 102*b;*

(ii) a width of the concentric band 102*b* is less than the width of concentric band 102*c;*

(iii) a width of the concentric band 102*c* is less than the width of concentric band 102*d;*

(iv) a width of the concentric band 102*d* is less than the width of concentric band 102*e*; and (v) a width of the concentric band 102*e* is less than the width of concentric band 102*f.*

In addition, the interspacing distance between the concentric bands 102*a*, 102*b*, 102*c*, 102*d*, 102*e* and 102*f* can be formed with a distance that increases inwardly within the structure, as the bands reach the center 105 of the structure 100. Specifically, (i) a distance between concentric bands 102*a*, 102*b* is greater than a distance between concentric bands 102*b*, 102*c;*

(ii) a distance between concentric bands 102*b*, 102*c* is greater than a distance between concentric bands 102*c*, 102*d;*

(iii) a distance between concentric bands 102*c*, 102*d* is greater than a distance between concentric bands 102*d*, 102*e*; and (iv) a distance between concentric bands 102*d*, 102*e* is greater than a distance between concentric bands 102*e*, 102*f.*

Still referring to FIG. 1, in embodiments, B0 and B1 are representative of shorts for adjusting the frequency of the inductor. For example, at short B0, L=2L used at the highest frequency, at short B1, L=4L used at an intermediate frequency and at open B0 B1, L=6L used at a lowest frequency.

Figure 2:
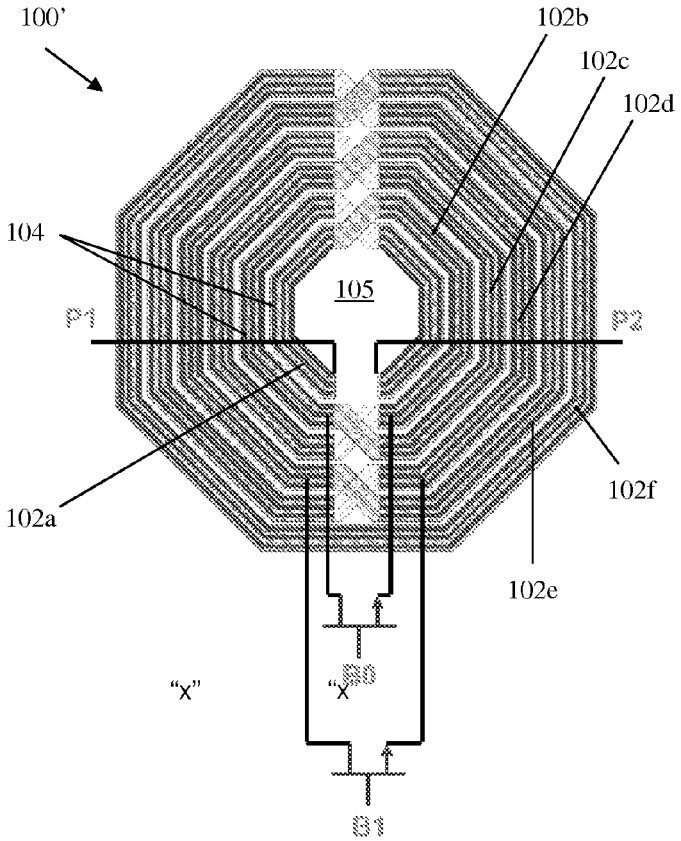
FIG. 2 is a top-down view showing an inductor in accordance with additional aspects of the disclosure.

FIG. 2 is a top-down view showing an inductor in accordance with additional aspects of the disclosure. In the structure 100' of FIG. 2, the concentric bands 102*a*, 102*b*, 102*c*, 102*d*, 102*e* and 102*f* can be made in a symmetrical pattern (although other patterns are also contemplated herein), and can be formed with a constant width and inter-distance spacing between the concentric bands 102*a*, 102*b*, 102*c*, 102*d*, 102*e* and 102*f*. As already described herein, a low-k dielectric area 104, e.g., an airgap or low-k or ultra low-k dielectric material, is formed within the inner concentric bands, e.g., between 102*a*, 102*b* and 102*b*, 102*c*. For example, the area comprising the airgap or low-k or ultra low-k dielectric material can be provided in the high frequency portion of the inductor, e.g., the center of the inductor. Also, the low-k dielectric area 104 can be about, e.g., 25 μm×25 μm (compared to an entire area of the inductor, e.g., 250 μm×250 μm), thus reducing self-heating by approximately 100× compared to placing a low-k dielectric material over the entire inductor. Also, as in each of the aspects described herein, the use of other insulator material with a higher-k dielectric constant (compared to air or low-k or ultra low-k dielectric material 104), e.g., silicon dioxide, is provided about the remaining portions of the inductor to improve fracture strength (mechanical strength) and provide thermal stability.

Still referring to FIG. 2, the inner metal band 102*a* further comprises ports P1, P2 which may be used as a contact point for the inductor structure. Also, although the inductor 100' is described with regard to a hexagonal spiral structure, one of skill in the art would understand that the metal wiring structures, e.g., 102*a*, 102*b*, 102*c*, 102*d*, 102*e*, 102*f*, may be formed in any number of different shapes, including octagonal, square, rectangle, circular, etc., with a certain number of turns, e.g., three, five, six, seven, etc. The concentric bands 102*a*, 102*b*, 102*c*, 102*d*, 102*e* and 102*f* of the inductor structure 100' can be made of any metal material, for example, copper, tungsten, aluminum, or other suitable conductors or combinations thereof using conventional CMOS fabrication processes as noted herein.

Also, similar to FIG. 1, in embodiments, B0 and B1 are representative of shorts for adjusting the frequency of the inductor. For example, at short B0, L=2L used at the highest frequency, at short B1, L=4L used at an intermediate frequency and at open B0 B1, L=6L used at a lowest frequency. Also, as in each of the aspects described herein, the use of other insulator material with a higher-k dielectric constant 107 (compared to air or low-k dielectric material 104) is provided about the remaining portions of the inductor to improve fracture strength (mechanical strength) and provide thermal stability.

FIG. 3 is a cross-section view of an inductor structure in accordance with aspects of the present disclosure. In FIG. 3, the inductor structure 100" includes a 6 turn inductor with metal windings (conductive bands) 102*a*, 102*b*, 102*c*, 102*d*, and 102*e*. In this configuration, the metal windings 102*a*, 102*b*, 102*c*, 102*d*, and 102*e* can include one or multiple wiring levels, M1, M2, M3, M4 and M5. In this structure 100", the inner inductor capacitance is lowered by stacking fewer wires in the center, e.g., metal windings 102*a*, 102*b*. Also, the inner inductor capacitance is lowered by forming the airgap 104 between metal windings 102*a*, 102*b* and between metal windings 102*b*, 102*c*.

In embodiments, the airgap, low-k or ultra low-k dielectric material 104 can extend to any of the metal layers, e.g., M1, M2 or combinations thereof. For example, the low-k dielectric area 104 (e.g., airgap, low-k or ultra low-k dielectric material) can extend to the bottom of the first metal layer M1 for the space between the first and second windings, e.g., winding 102*a*, 102*b*, and to the bottom of the second metal wiring layer M2 for the space between the second and third windings, e.g., windings 102*b*, 102*c*. Alternatively, the airgap, low-k or ultra low-k dielectric material can extend to the bottom of the second metal layer M2 for the space between the first and second windings, e.g., winding 102*a*, 102*b*, and to the bottom of the third metal wiring layer M3 for the space between the second and third windings, e.g., windings 102*b*, 102*c*. The multiple metal bands can be a standalone, single band, e.g., 102*a*, parallel stacked bands, e.g., 102*b*, 102*c* and series bands 102*d*, 102*e*. As in each of the embodiments described herein, by tapping the center portion, it is possible to form a high frequency inductor (L and Q); whereas, tapping the whole inductor will form a low frequency inductor (L and Q) (Q low frequency~omega*L/R and at high freq–C).

Still referring to FIG. 3, it should be recognized by those of skill in the art that other multiple bands and metallization layers are also contemplated herein, with airgap 104 provided between the inner bands. Also, although the structure 100" is shown with bands of varying width and spacing therebetween, the structure 100" can also be representative of bands with constant widths and spacings therebetween, or any combination thereof. In general, when designing an inductor structure for use within a narrow frequency range, the interspacing changes more gradually from the outer bands towards the center of the structure. Conversely, when designing an inductor structure for use within a wider frequency range, the interspacing changes more aggressively from the outer bands towards the center of the structure. Hence, interspacing is an important parameter to consider when designing inductor structures in accordance with embodiments of the present disclosure.

Figure 4:
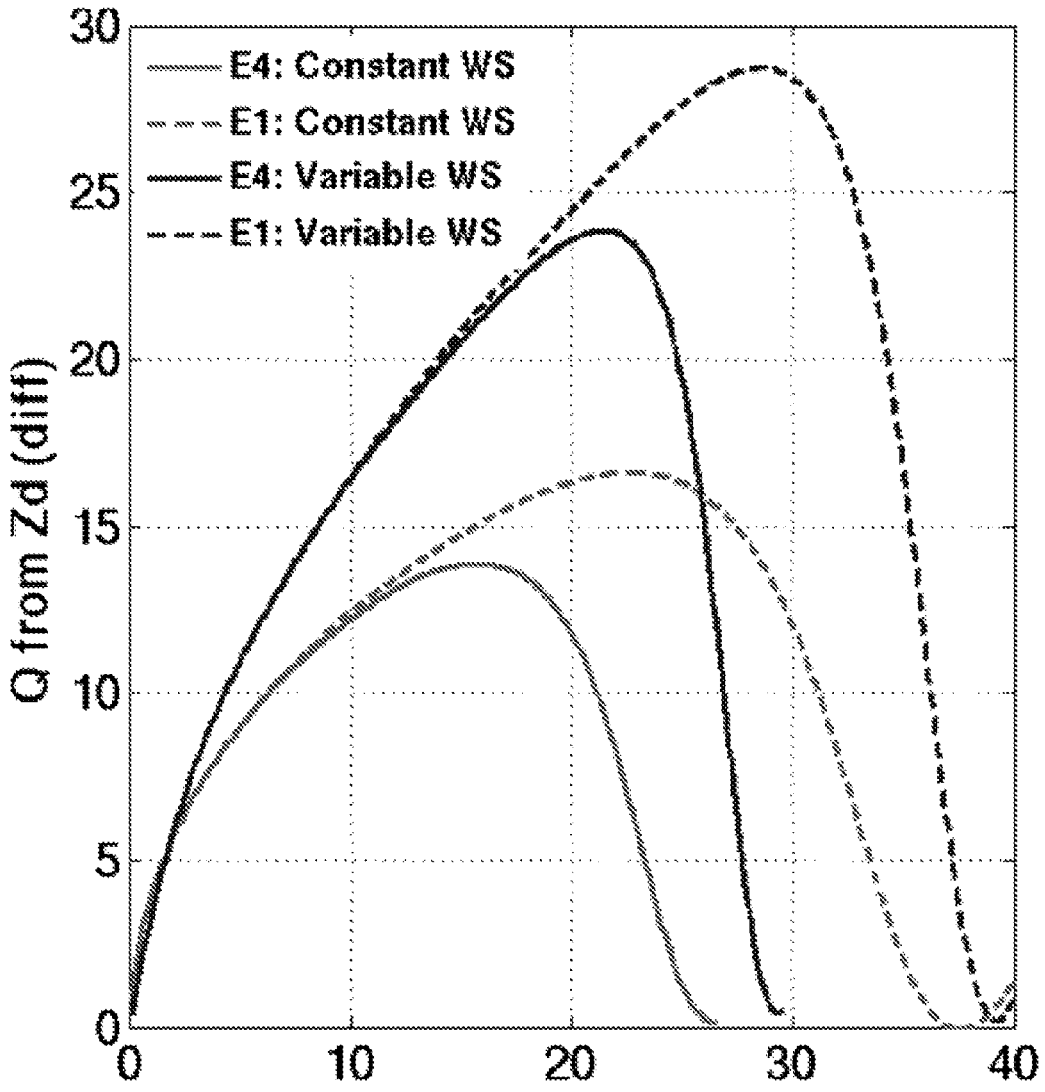
FIG. 4 shows a comparison graph between the multi-frequency inductors described herein and conventional inductors, demonstrating a performance improvement in accordance with aspects of the present disclosure.

FIG. 4 shows a comparison graph between the inductors described herein and conventional inductors, demonstrating a performance improvement in accordance with aspects of the present invention. More specifically, in FIG. 4, the y-axis represents quality of the inductor, Q, and the x-axis represents frequency of operation. The inductors labeled E1 represent inductors with an airgap, whereas, the inductors labeled E4 are conventional inductors without an airgap or other low-k dielectric area. The inductors labeled E1 and E4 both include metal windings with constant and variable width and spacing between the windings. As shown in FIG. 4 and represented in Table 1, below, the inductors labeled E1 show a 34% improvement of $Q_{max}$, a 20% improvement in $f_{Qmax}$ and a 35% improvement in self resonant frequency (SRF).

TABLE 1

| | $Q_{max}$ | $f_{Qmax}$ | SRF |
|---|---|---|---|
| E4 | 21.3 | 23.8 | 29.2 |
| E1 | 28.7 | 28.7 | 39.4 |

The method(s) as described above is used in the fabrication of integrated circuit chips. The resulting integrated circuit chips can be distributed by the fabricator in raw wafer form (that is, as a single wafer that has multiple unpackaged chips), as a bare die, or in a packaged form. In the latter case the chip is mounted in a single chip package (such as a plastic carrier, with leads that are affixed to a motherboard or other higher level carrier) or in a multichip package (such as a ceramic carrier that has either or both surface interconnections or buried interconnections). In any case the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed:

1. A structure, comprising:

a plurality of concentric conductive bands;

a low-k dielectric area selectively placed between inner windings of the plurality of concentric conductive bands having interconnected wiring layers; and insulator material with a higher-k dielectric material than the low-k dielectric area selectively placed between remaining windings of the plurality of concentric conductive bands having interconnected wiring layers in a different configuration than the inner windings.

2. The structure of claim 1, wherein the inner windings have fewer stacked wiring layers out of the interconnected wiring layers than the remaining windings of the plurality of concentric conductive bands.

3. The structure of claim 1, wherein the low-k dielectric area is at a center of the plurality of concentric conductive bands.

4. The structure of claim 3, wherein the low-k dielectric area is smaller compared to an overall inductor size.

5. The structure of claim 1, wherein the low-k dielectric area is an airgap.

6. The structure of claim 1, wherein the plurality of concentric conductive bands are symmetrical.

7. The structure of claim 6, wherein the plurality of concentric conductive bands have different wiring levels.

8. The structure of claim 7, wherein the low-k dielectric area extends to a bottom of a wiring level associated with the inner windings.

9. The structure of claim 8, wherein the inner windings are two innermost windings and the low-k dielectric area extends to a different wiring for each of two innermost windings.

10. The structure of claim 9, wherein the low-k dielectric area is a low-k or ultra low-k dielectric material.

11. The structure of claim 9, wherein the low-k dielectric area is provided in a high frequency portion of the plurality of concentric conductive bands, and a width of each concentric conductive band out of the plurality of concentric conductive bands decreases inwardly as the plurality of concentric conductive bands reach a center of the structure.

12. A multi-port inductor structure, comprising:

a plurality of conductive bands;

an airgap or low-k dielectric material placed between two innermost windings of the plurality of conductive bands having interconnected wiring layers in a parallel stacked band configuration; and an insulator material with a dielectric constant greater than the airgap or low-k dielectric material is selectively placed between remaining windings of the plurality of conductive bands having interconnected wiring layers in a series band configuration.

13. The multi-port inductor structure of claim 12, wherein the plurality of conductive bands are symmetrical bands.

14. The multi-port inductor structure of claim 13, wherein the low-k dielectric material is ultra low-k dielectric material.

15. The multi-port inductor structure of claim 13, wherein the two innermost windings have fewer stacked wiring layers out of the interconnected wiring layers than remaining windings of the plurality of conductive bands.

16. The multi-port inductor structure of claim 15, wherein the airgap or low-k dielectric material is provided at different wiring layers for the two innermost windings, and an interspacing distance between each concentric conductive band out of the plurality of concentric conductive bands increases inwardly as the plurality of concentric conductive bands reach a center of the structure.

17. The multi-port inductor structure of claim 13, wherein the airgap or low-k dielectric material is provided in a high frequency portion of the plurality of conductive bands.

18. The multi-port inductor structure of claim 12, wherein the insulator material is silicon dioxide.

19. A method, comprising:

forming a plurality of conductive bands with two innermost windings having interconnected wiring layers in a first configuration and remaining windings having interconnected wiring layers in a second configuration;

forming low-k dielectric area between two innermost windings of the plurality of conductive bands; and forming an insulator material with a dielectric constant greater than the low-k dielectric area between remaining windings of the plurality of conductive bands.

* * * * *